US006306067B1

(12) United States Patent
Gizas

(10) Patent No.: US 6,306,067 B1
(45) Date of Patent: Oct. 23, 2001

(54) EXERCISE FURNITURE

(76) Inventor: Chris Gizas, 11 Maple Ave., Dover, NJ (US) 07801

( * ) Notice: Subject to any disclaimer, the term of this patent is extended or adjusted under 35 U.S.C. 154(b) by 0 days.

(21) Appl. No.: 09/329,377

(22) Filed: Jun. 10, 1999

(51) Int. Cl.[7] ..... A63B 21/06

(52) U.S. Cl. ..... 482/102; 482/79; 482/133; 482/142; 482/904

(58) Field of Search ..... 482/99–103, 79, 482/130, 133, 138, 139, 142, 904; 601/24; 606/242

(56) References Cited

U.S. PATENT DOCUMENTS 223,668 * 1/1880 Duplessis .
1,561,979 * 11/1925 Gore .
4,243,219 * 1/1981 Price ..... 272/117
4,691,918 * 9/1987 Rockwell ..... 272/134
4,913,423 * 4/1990 Farran et al. ..... 272/134

* cited by examiner

*Primary Examiner*—Mickey Yu
*Assistant Examiner*—Victor Hwang
(74) *Attorney, Agent, or Firm*—Thomas L. Adams

(57) ABSTRACT

An exercise apparatus may be built into a couch or other seating assembly. The seating assembly may have a pair of side structures and a seating area between the side structures. The seating assembly may be a couch having a rear face, a pair of arms and a seating area between the arms sized to seat at least two people. A case is mounted alongside one of the side structures of the seating assembly. A cable is routed through the seat assembly to the case. This cable has one end routed to emerge through the seat assembly for pulling exercises. An adjustable weight is mounted in the case and coupled to the cable. The weight can be lifted in response to pulling of the cable. The adjustable weight is accessible in a region that is spaced from the rear face of the couch to avoid any need for clearance behind the couch in order to gain access to the adjustable weight.

20 Claims, 5 Drawing Sheets

EXERCISE FURNITURE

BACKGROUND OF THE INVENTION

1. Field of the Invention

The present invention relates to exercise apparatus, and in particular, to apparatus associated with a couch or other seating assembly.

2. Description of Related Art

With the wide recognition of the benefits of regular exercise, people have been increasing the opportunities to exercise by bringing exercise equipment into their homes. Conventional exercise equipment employs a frame having a system of cables and pulleys to lift an adjustable weight. The exerciser can stand or can rest on a seat or bench next to the frame in order to manually pull an end of the cable. Conventional exercise apparatus of the foregoing type are shown in U.S. Pat. Nos. 321,388; 4,372,553; 4,549,733; and 4,603,855.

With one known exercise machine, the exerciser stands between a pair of spaced frames. The exerciser can pull an opposing pair of cables on the frames to lift an adjustable weight with the cable system. A variety of exercises can be performed with this equipment, such as butterfly exercises. The cable can be routed in a bight around a reversing pulley attached to an adjustable weight. Thus the exerciser can pull either end or both ends of the cable to lift the adjustable weight.

A disadvantage with these exercise machines is the relatively large amount of floor space required by them. Many apartments and homes do not have a sufficient number of rooms or rooms large enough to accommodate such exercise machines. On the other hand, where the space is available a homeowner may find the exercise equipment aesthetically dissonant with the furnishings or decorations in the room where the exercise is to take place.

In U.S. Pat. Nos. 382,440 and 337,942 exercise machines having cable-lifted weights are mounted in tall boxes that are finished like furniture. While attractive, these devices are dedicated exercise machines and therefore still require the same amount of floor space as conventional exercise apparatus.

In U.S. Pat. No. 4,913,423 a chair is outfitted with cables that can be pulled by means of handles located atop the arms and the back of the chair. Similarly, a leg device can use cables pulled from the foot of the chair. This reference shows a double chair in FIG. 8. A disadvantage with exercise equipment of the foregoing type is the difficulty adjusting the effort level. The above exercise apparatus employs internal springs that establish the cable tension during exercise. This produces a tension that is not readily adjusted without disassembling the chair. Also, the tension on the exercise cable increases in accordance with the spring constant of the spring. In one embodiment of this known exercise device, a stack of adjustable weights are mounted in the back of the chair. Accordingly, the chair cannot be positioned against the wall, since the user will then be denied access to the weights for the purpose of adjustment.

U.S. Pat. No. 3,893,667 shows a small seat containing a system of springs that can be pulled from various directions by means of cables. Again, this reference has the disadvantages associated with springs.

U.S. Pat. No. 5,267,926 shows a chair that is fitted with exercise apparatus, including a pair of cables that can be used to lift weights. When installed on a chair, however, this apparatus interferes with use as an ordinary chair. See also U.S. Pat. No. 1,114,458.

U.S. Pat. No. 3,218,067 shows an exercise machine that is mounted in a headboard. This device uses elastic cables that can be wound onto a reel. This arrangement has the same disadvantage as the spring operated machines.

Elaborate and aesthetically unappealing apparatus mounted on beds are shown in U.S. Pat. Nos. 2,057,811 and 3,455,295.

Accordingly, there is a need for exercise apparatus that does not require a large amount of floor space and can be placed in room without upsetting its decor.

SUMMARY OF THE INVENTION

In accordance with the illustrative embodiments demonstrating features and advantages of the present invention, there is provided an exercise apparatus with a couch having a seating area sized to seat more than one person. The apparatus has an engagement means mounted at least partially inside the couch with a distal end adapted for reciprocation. Also included is an exercise means coupled to the engagement means for applying a force to the distal end in order to exercise one who reciprocates the distal end.

In accordance with another aspect of the invention, an exercise apparatus is provided with a seating assembly having a pair of side structures and a seating area between the side structures. Also included is a case mounted alongside one of the side structures of the seating assembly. The apparatus also has a cable routed through the seat assembly to the case. The cable has one end routed to emerge through the seat assembly for pulling exercises. The apparatus also has an adjustable weight mounted in the case and coupled to the cable to be lifted in response to pulling of the cable.

In accordance with still another aspect of the invention, an exercise apparatus is provided with a couch having a rear face, a pair of arms and a seating area between the arms sized to seat at least two people. The exercise apparatus also includes a cable that is routed through the couch to emerge from the couch near the arms for pulling exercises. Also included is an adjustable weight coupled to the cable to be listed in response to pulling of the cable. The adjustable weight is accessible in a region that is spaced from the rear face of the couch to avoid any need for clearance behind the couch in order to gain access to the adjustable weight.

By employing equipment of the foregoing type, an improved exercise apparatus is achieved. In the preferred embodiment exercise apparatus is associated with a couch. The assembly is built with a rectangular case mounted next to one arm of the couch. In this preferred embodiment the case is designed as a decorative column upon which a lamp may be placed. The case however, contains a adjustable weight that is lifted by a header that can roll on a pair of vertical tracks inside the case. The weights may be lifted by a cable system that is routed between the case and the couch. In other embodiments, the weights may be replaced with springs, elastomeric cords or other devices that can be stretched or deformed to provide muscle resistance to the exerciser.

In one preferred embodiment, a cable system terminates in a pair of attachment loops that protrude through openings on the inside of each of the arms of the couch. Handles or other exercise devices can be attached to these loops by clasps or the like. A stop, preferably mounted in the arms of the couch, can prevent the cable from retracting into the arm and getting lost.

The cable is preferably routed in two stretches from the two couch arms into the case. Inside the case, the cables may be routed under a pair of lower pulleys and over a pair of upper pulleys before they meet and loop a reversing pulley mounted on a header that holds the weights. Arranged in this preferred fashion, the two ends of the cable emerging from the couch arms can be used individually or together to lift the adjustable weight. The tension on the cable system can be changed, for example, by stacking a selectable number of weight plates on the header.

In one embodiment, an additional cable line can protrude from an end of the couch opposite the case. This additional cable line can protrude at a low elevation and can be used with a strap or other device for leg exercises.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention, when taken in conjunction with the accompanying drawings, wherein.

DETAILED DESCRIPTION OF THE PREFERRED EMBODIMENTS

Figure 1:
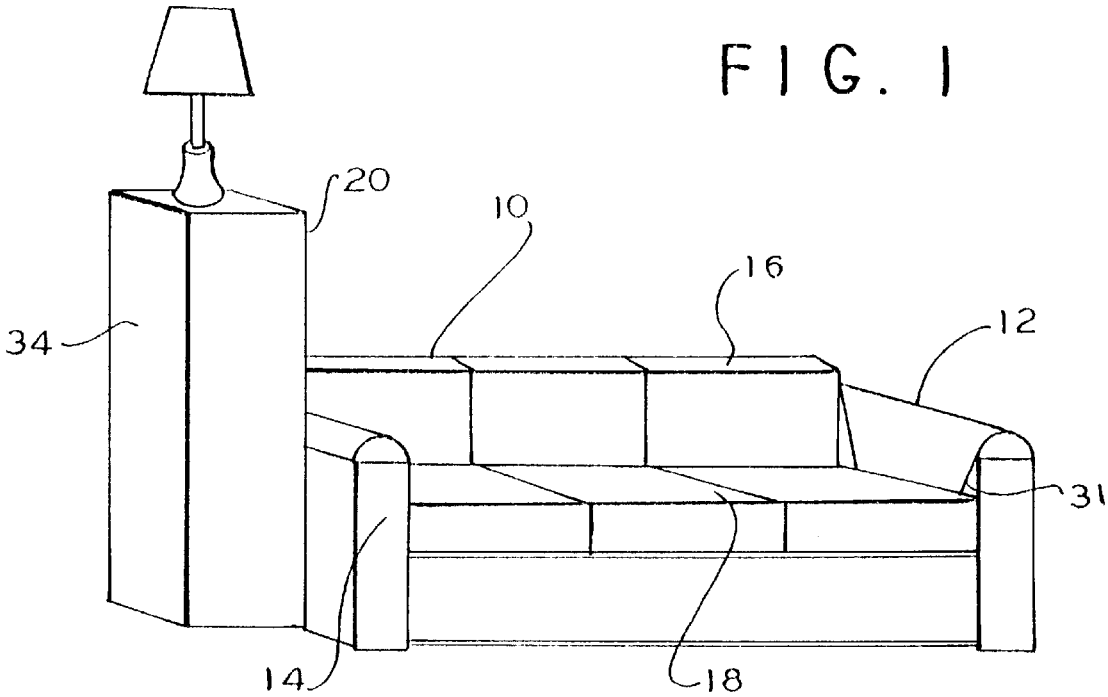
FIG. 1 is an axonometric view of a exercise apparatus with its exercise features concealed and shown in the form of a couch with an adjoining stand.
Figure 2:
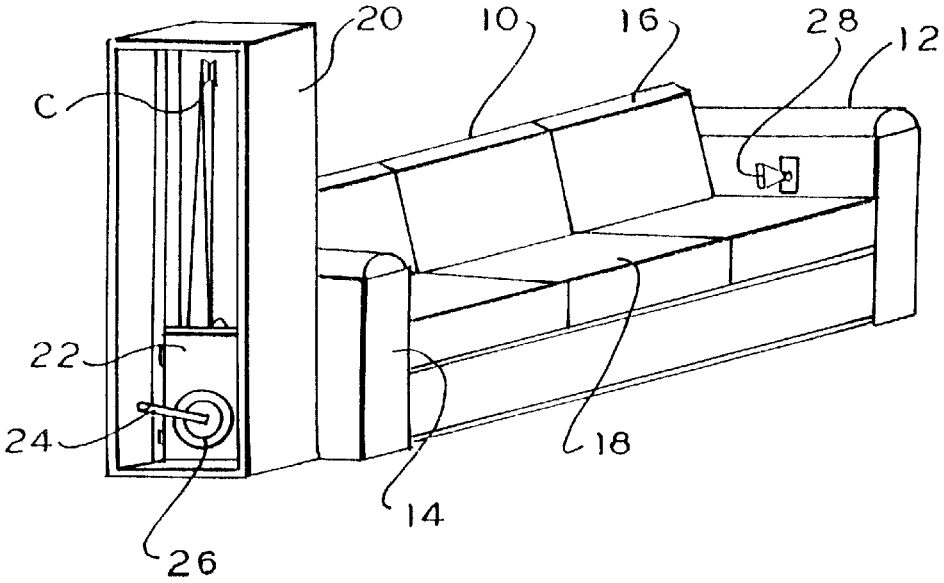
FIG. 2 is an axonometric view of the apparatus of FIG. 1 with the door of the case removed and the couch arms uncovered to reveal the exercise features.

Referring to FIGS. 1 and 2, an exercise apparatus is shown employing a seating assembly in the form of a couch 10 having a pair of side structures, namely arms 12 and 14. Couch 10 has a back 16 with a front and rear face. Couch 10 also has a seating area 18 between the arms 12 and 14.

Next to arm 14 is a case 20 shown containing an adjustable weight in the form of a header 22 supporting a rod 24. A selectable number of weight plates 26 are shown stacked on rod 24. A cable C is shown mounted inside case 20 to follow a routing that will be described presently. Cable C is at times referred to as an engagement means, and weight 26 is also referred to as an exercise means.

While shown adjacent arm 14, in other embodiments the case can be mounted adjacent arm 12. While this case is rectangular, in other embodiments the case can be cylindrical, a polygonal prism, a frustrum of an ovoid, etc. Also, case 20 can be finished with an appropriate wood or plastic laminate or may be made of a fine wood that can be finished appropriately.

A handle 28 connected to one end of cable C is shown protruding inwardly from the inside face of arm 12 in FIG. 2. In FIG. 1, the handle 28 has been detached from the cable and an arm cover 31 is shown concealing the opening for the cable in arm 12. Another handle (to be described presently) and is associated with arm 14.

Figure 3:
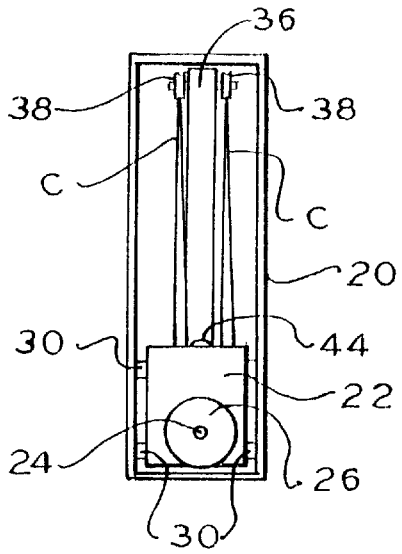
FIG. 3 is a side elevational view of the case of FIG. 2.
Figure 4:
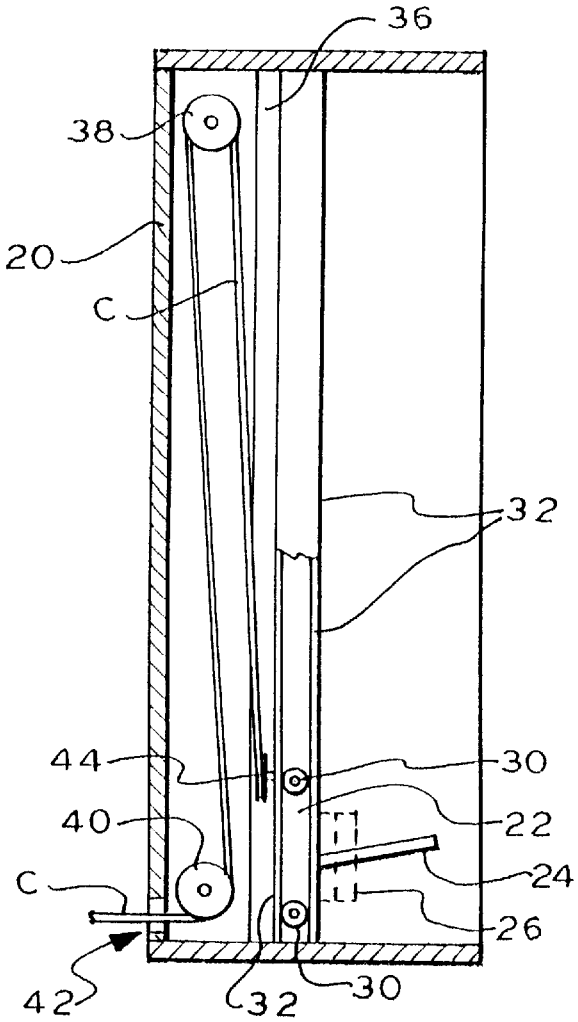
FIG. 4 is a rear elevational view, partly in section, of the case of FIG. 3.
Figure 5:
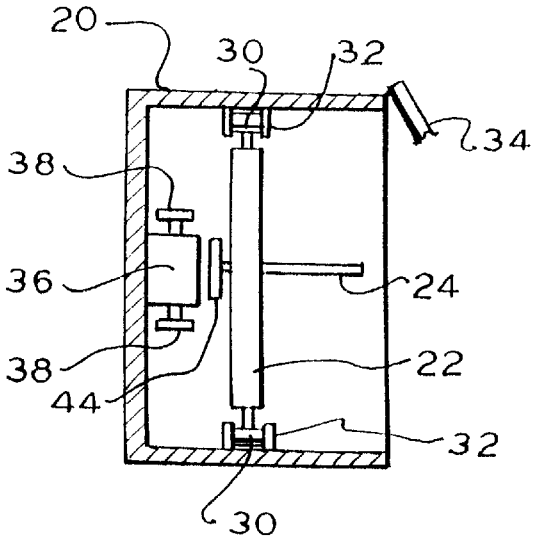
FIG. 5 is a top plan view , partly in section, of the case of the FIG. 3.

Referring to FIGS. 3, 4, and 5, a header is shown as a rectangular palette 22 having on its right and left edges two pairs of wheels 30. Wheels 30 roll within the pair of tracks 32, which are channels mounted on opposing inside faces of case 20. A rod 24 is shown angled slightly upwardly out from header 22 for the purpose of holding a stack of weight plates 26.

A door 34 is shown hingedly attached to one corner of case 20. In other embodiments door of the case can be positioned on various sides and can be hinged in various ways. Mounted opposite door 34, inside case 20 is a vertical support beam 36 running the full height of the inside of case 20. Mounted near the top, on opposite sides of beam 36, are a pair of upper pulleys 38. Mounted on opposite sides near the bottom of support beam 36, are a pair of lower transition pulleys 40. Transition pulleys 40 are mounted adjacent a pair of openings 42 along the bottom of the wall of case 20, opposite door 34. Journaled on the back of header 22, opposite rod 24 is a reversing pulley 44, used for a purpose to be described presently. While shown on the back of the header, this reversing pulley can be positioned on the front, top edge or elsewhere in other embodiments.

Figure 6:
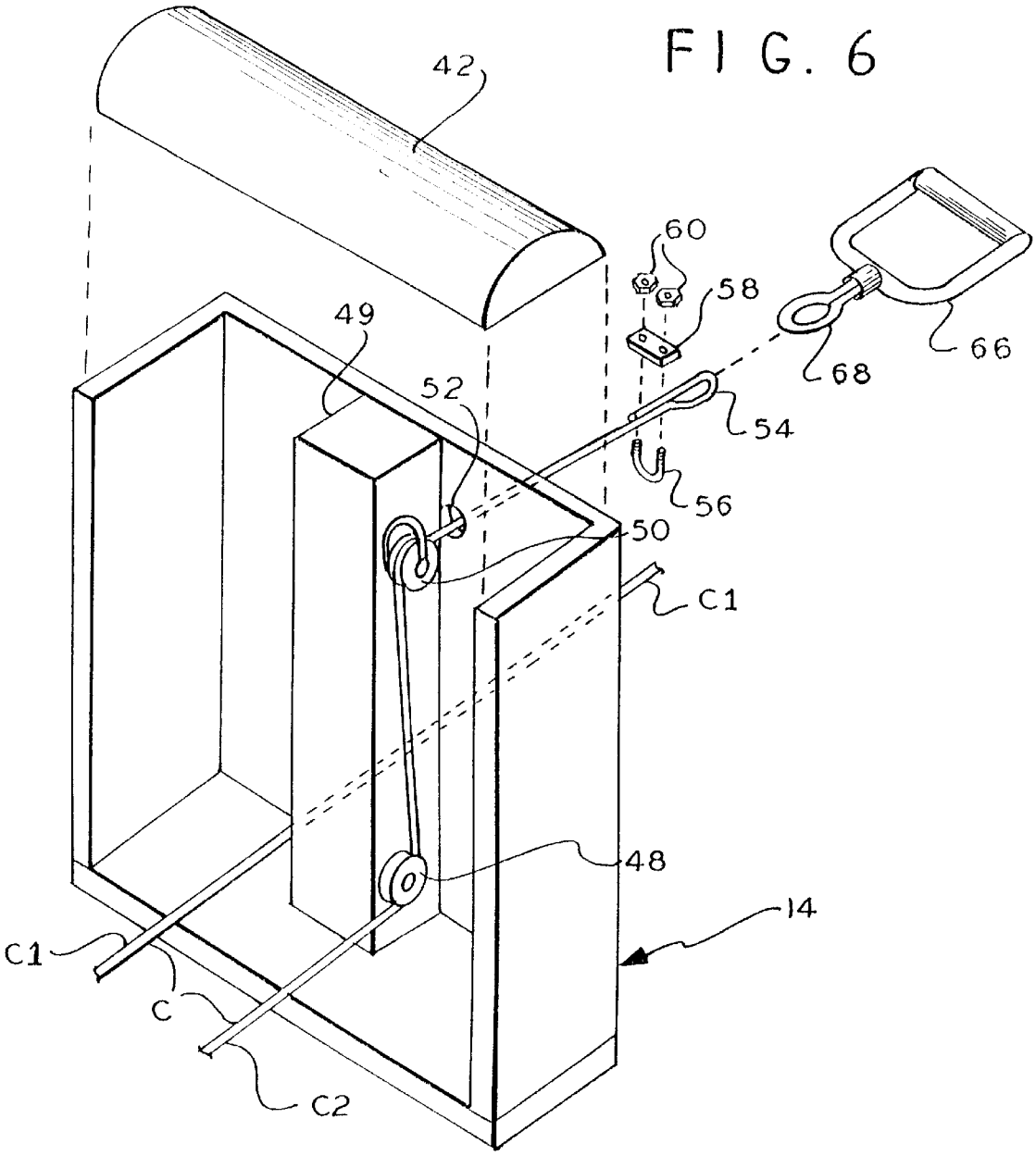
FIG. 6 is an exploded, axonometric view of the couch arm shown next to the case in FIG. 2.
Figure 7:
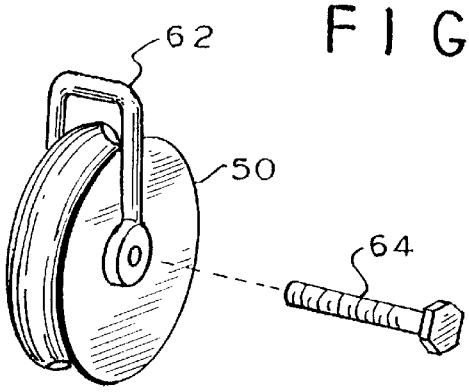
FIG. 7 is a detailed, exploded view of the pulley and stop of FIG. 6.

Referring to FIGS. 6 and 7, previously mentioned couch arm 14 is shown with its outside covering and padding removed, as well as one of its side panels, to reveal the mechanism inside the arm. The cap 42 is shown removed for illustrative purposes. Arm 14 is shown containing an internal beam 49 supporting an upper pulley 50, and a lower pulley 48.

Two stretches of cable C passing through the arm are shown as follows: stretch C1 is shown passing through arm 14 to continue along the bottom of the couch. Stretch C2 is shown passing under lower pulley 48 and over upper pulley 50 to pass through hole 52 before terminating in a cable loop 54. Loop 54 is secured by means of U-bolt 56 that squeezes the end of the cable against the plate 58 using nuts 60. With loop 54 secured in this fashion, it cannot be drawn into the arm 14 and lost. For this purpose, a U-shaped stop 62 is mounted on the bolt/axle 64 of upper pulley 50. Accordingly, the hardware 56/58 cannot pass through the stop 62 and therefore loop 54 will remain exposed. Thus, handle 66 may be attached to loop 54 by using the clasp 68 at the inside end of the handle. Previously mentioned handle 28 (FIG. 2) is constructed and attached to cable C1 in the same way.

Figure 8:
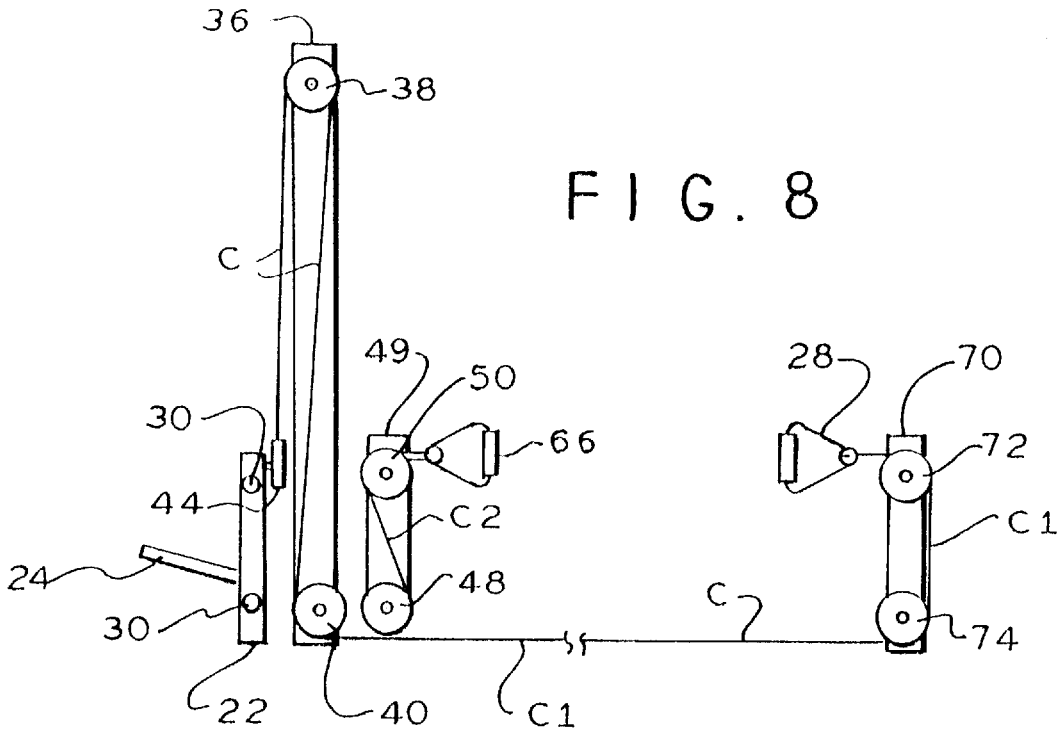
FIG. 8 is a schematic illustration of the pulley system of FIG. 2.
Figure 9:
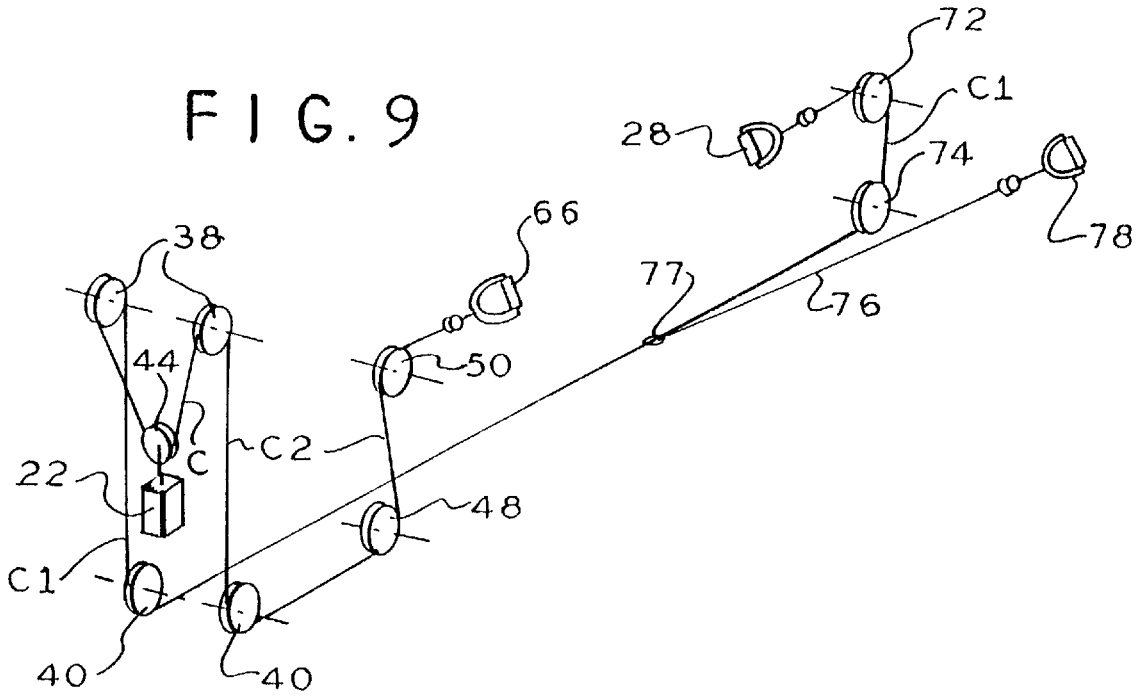
FIG. 9 is a schematic illustration of a pulley system of FIG. 8, shown with an additional cable line.

Referring to FIGS. 8 and 9, cable C is shown routed over previously mentioned pulleys 38, 40, 44, 48 and 50. In FIG. 8, pulleys 38 and 40 are shown mounted on vertical beam 36, while pulleys 48 and 50 are mounted on beam 49 inside one couch arm. In the opposite couch arm, vertical beam 70 is shown supporting an upper pulley 72 and a lower pulley 74. Accordingly, beam 70 and its pulleys are structured in a manner similar to beam 49 and pulleys 48 and 50.

In FIG. 8, cable C is shown traveling over and to the outside of pulley 72 before passing under lower pulley 74. Thereafter, cable C passes through the couch (underneath the seating area 18 of the couch 10 of FIG. 1) to follow stretch C1. See also FIG. 6. Stretch C2 is shown, as before, passing over pulley 50 and under pulley 48.

In FIG. 9, stretches C1 and C2 are shown passing under pulleys 40 and rising to pass over the top of upper pulleys 38. Thereafter, stretches C1 and C2 join in a bight that passes under reversing pulley 44, which can lift the weight header 22. Pulley 44 is shown on the back of header 22, but in other embodiments can be positioned at the front, the top edge, etc.

To facilitate an understanding of the principles associated with the foregoing apparatus, its operation will now be briefly described. The door 34 may be opened to expose the header 22 (FIGS. 1 and 2). The user can then place an appropriate number of weight plates 26 on the rod 24 of header 22. Handles 28 and 66 may be stored on hooks (not shown) on the back of door 34. Accordingly, door 34 functions as a means of storing exercise accessories, namely, handles 28 and 66. The covers 31 on arms 12 and 14 may be removed to expose the loops on the ends of cable C. In FIG. 6 the handle 66 is shown with its clasp 68 adjacent to loop 54. The clasp 68 can be opened and hooked around loop 54 in a conventional manner. Handle 28 (FIGS. 8 and 9) can be installed in a similar manner.

The user can then stand near or sit anywhere on couch 10. For example, the user can sit next to one of the arms 12 or 14 to use one of the ends of cable C. Alternatively, the user can sit centrally on seating area 18 of couch 10 and pull on both ends of cable C, simultaneously.

Referring to FIGS. 8 and 9, when user pulls on handle 66, stretch C2 of cable C is pulled over pulley 50 and under pulleys 40 and 48. Consequently, stretch C2 of cable C is pulled over the top of one of the pulleys 38 to shorten the bight that is located between pulleys 38 and under reversing pulley 44. Referring to FIG. 3, 4 and 5, header 22 rises while its rollers 30 ride in the tracks 32.

If handle 28 (FIG. 9) is pulled (instead of or simultaneously with handle 66) stretch C1 of cable C is pulled over pulley 72 and under pulleys 74 and 40. As a result, cable C is pulled over the top of one of the pulleys 38 to shorten the bight that is located between pulleys 38 and under reversing pulley 44, to lift weight header 22.

FIG. 9 illustrates an additional feature for alternate embodiments. Specifically, a line 76 is shown tied at point 77 along the stretch C1 of cable C. Line 76 is shown traveling past the arm area containing pulleys 72 and 74. In this embodiment line 76 emerges to the outside of the couch arm (arm 12 of FIG. 2). Line 76 is shown coupled to a leg exercising accessory 78 such as a leg bracelet or strap. Thus, a user may slip a foot into the accessory 78. Since the line 76 emerges at a relatively low elevation, the user can readily exercise a leg by pulling with the leg on line 76. The cable C can then lift the adjustable weight in a fashion similar to that described in connection with the pulling of handle 28.

Figure 10:
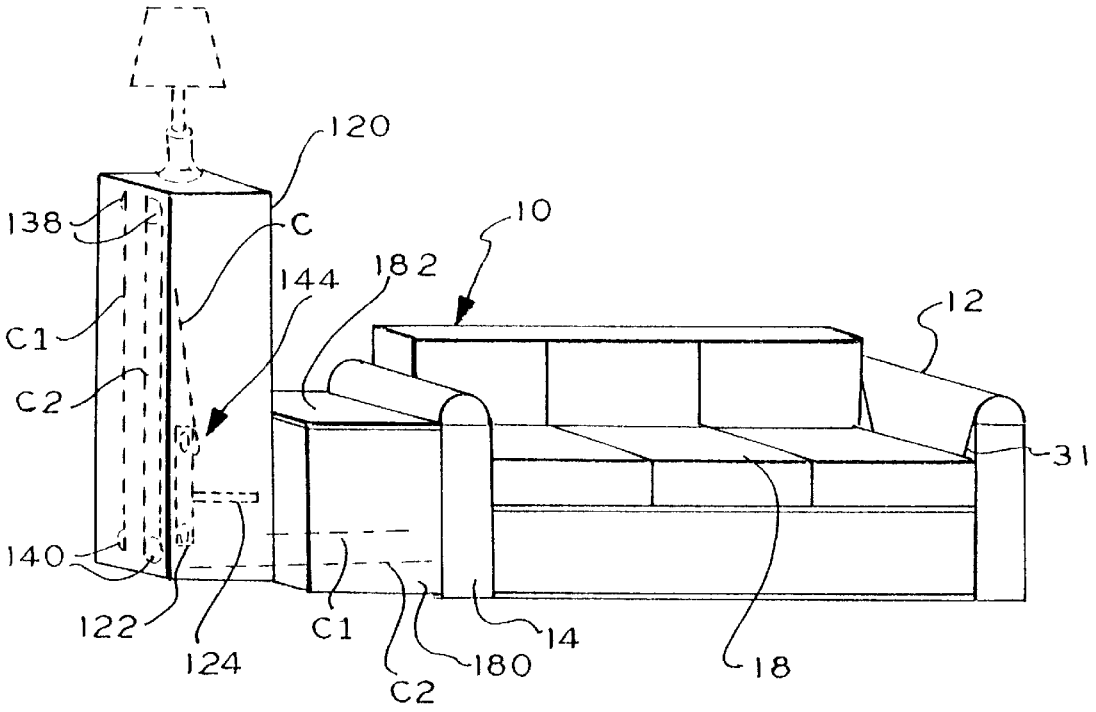
FIG. 10 is an axonometric view of an exercise apparatus that is an alternate to that of FIGS. 1 and 2, employing an intervening end table and with its exercise mechanism shown in phantom.

Referring to FIG. 10, previously mentioned couch 10 is shown again with arms 12 and 14 and seating area 18. The previously mentioned cables loops and handles located at or in couch 10 are the same as before. The previously illustrated case is shown herein as alternate case 120, which has been spaced from arm 14 by an intervening, rectangular end table 180.

The case 120 contains the same mechanism as before, except reversed, right to left. Corresponding components have a reference numeral that was increased by one hundred over the correspondent. Accordingly, weight header 122 is shown mounted with its rod 124 pointing toward couch 10. As a clear variation over the embodiment of FIG. 2, reversing pulley 144 is shown on the same side as the rod 124. Pulleys 138 and 140 are shown mounted to the outside of case 120.

Cable stretches C1 and C2 pass through end table 180 to pass under pulleys 140 and over pulleys 138, before joining in the bight located between pulleys 138 and under reversing pulley 144. Routed in this fashion, the cable C can lift the adjustable weight in essentially the same manner as with the other embodiment.

The exposed faces of case 120 are closed. One can gain access to header 122 and rod 124 for the purpose of adding weights, by lifting the top 182 of end table 180. No wall exists at the intersection between table 180 and case 120. Therefore, the user can add or remove weights from rod 124 through end table 180.

It will be appreciated that still other modifications may be implemented with respect to the above described, preferred embodiments. In some embodiments the adjustable weight may be formed from a horizontal stack of weight plates that may be connected by a pin to a vertical rod depending from a header. In other embodiments, the weights may be replaced with springs, elastomeric cords or other devices that can be stretched or deformed to provide muscle resistance to the exerciser. The couch may have various, aesthetically pleasing shapes and design features in other embodiments. While the ends of the cables are shown connected to handles, other grasping devices can be used such as pulling bars, cloth loops etc. While a loop and clasp is shown for connecting the handle to the cable end, in other embodiments the handle may be permanently attached from alternate fastening means. In other embodiments, the reversing pulley on the header can be mounted on a different elevation or can be mounted along the top edge of the header. In still other embodiments, the header can be an open frame made of various components that are fastened together by bolts, welding, etc. The size, dimensions and shape of the couch and the adjacent case can be altered depending upon the desired seating capacity, weight capacity, pulling range, aesthetic considerations, etc.

Obviously, many modifications and variations of the present invention are possible in light of the above teachings. It is therefore to be understood that within the scope of the appended claims, the invention may be practiced otherwise than as specifically described.

What is claimed is:

1. An exercise apparatus comprising:

a seating assembly having a pair of side structures and a seating area between said side structures, said side structures comprising a pair of arms each having an inside and an outside;

a case mounted alongside one of said side structures of said seating assembly, said case comprising means for storing exercise accessories;

a cable routed through said seat assembly to said case, said cable having a pair of ends routed to emerge through said seat assembly for pulling, said pair of ends emerging separately from the inside of respective ones of said arms above the seating area, the ends of said cable each terminating in a loop;

a pair of handles separately and detachably connected to the pair of ends of said cable, said handles each having a clasp for releasably engaging the loops at the ends of the cable;

a pair of upper pulleys mounted in said case, said cable being routed to loop through said case to form a bight, said cable extending upwardly from said bight to loop over said upper pulleys; and an adjustable weight mounted in said case and coupled to said cable to be lifted in response to pulling of said cable.

2. An exercise apparatus according to claim 1 wherein said seat assembly comprises a couch.

3. An exercise apparatus according to claim 1 wherein said arms comprise:

a pair of stops separately mounted in different corresponding ones of said arms for preventing the ends of said cable from entering said arms and becoming manually inaccessible.

4. An exercise apparatus according to claim 1 wherein said case has a door for granting access to said weight.

5. An exercise apparatus according to claim 1 wherein said case is taller than said side structures.

6. An exercise apparatus according to claim 1 wherein said bight is routed through said case for supporting and lifting said weight.

7. An exercise apparatus according to claim 6 comprising:

a reversing pulley mounted on said weight for receiving and guiding said bight of said cable.

8. An exercise apparatus according to claim 1 wherein said weight comprises:

a header mounted to reciprocate vertically in said case; and a plurality of plates adapted to be selectively carried by said header.

9. An exercise apparatus according to claim 8 comprising:

a pair of tracks mounted in said case for guiding said header, said header having a rod, said weight having a plurality of annular plates adapted to be manually placed around said rod.

10. An exercise apparatus comprising:

a seating assembly having a pair of side structures and a seating area between said side structures, said side structures comprising a pair of arms each having an inside and an outside;

a case mounted alongside one of said side structures of said seating assembly, said case comprising means for storing exercise accessories;

a cable routed through said seat assembly to said case, said cable having a pair of ends routed to emerge through said seat assembly for pulling, said pair of ends routed to emerge separately from the inside of respective ones of said arms above the seating area, the ends of said cable each terminating in a loop;

a pair of handles separately and detachably connected to the pair of ends of said cable, said handles each having a clasp for releasably engaging the loops at the ends of the cable;

an adjustable weight mounted in said case and coupled to said cable to be lifted in response to pulling of said cable, said cable being routed to loop through said case and form a bight for supporting and lifting said weight;

a pair of upper pulleys mounted in said case, said cable extending upwardly from said bight to loop over said upper pulleys a lower pair of transition pulleys mounted in said case, said cable extending downwardly from said upper pulleys, and around said transition pulleys, for one of said transition pulleys said cable extending under the seating area to one of said side structures.

11. An exercise apparatus comprising:

a seating assembly having a pair of side structures and a seating area between said side structures;

a case mounted alongside one of said side structures of said seating assembly;

a cable routed through said seat assembly to said case, said cable having one end routed to emerge through said seat assembly for pulling;

an adjustable weight mounted in said case and coupled to said cable to be lifted in response to pulling of said cable; and a line connected to said cable and routed under the seating area to emerge outside that one of the side structures opposite said case at an elevation suitable for leg exercises.

12. An exercise apparatus comprising:

a couch having a rear face, a pair of arms and a seating area between said arms sized to seat at least two people, said arms each have an inside and an outside;

a cable being routed through said couch to emerge from said couch near said arms for pulling, said cable having a pair of ends routed to emerge separately from the inside of respective ones of said arms above the seating area;

an adjustable weight coupled to said cable to be lifted in response to pulling of said cable, said adjustable weight being accessible in a region that is spaced from the rear face of the couch to avoid any need for clearance behind said couch in order to gain access to said adjustable weight, said cable being routed to form a bight for supporting and lifting said weight; and a pair of upper pulleys for guiding said cable, said cable extending upwardly from said bight to loop over said upper pulleys.

13. An exercise apparatus according to claim 12 wherein said arms comprise:

a pair of stops separately mounted in different corresponding ones of said arms for preventing the ends of said cable from entering said arms and becoming manually inaccessible.

14. An exercise apparatus according to claim 12 comprising:

a pair of handles separately and detachably connected to the pair of ends of said cable.

15. An exercise apparatus according to claim 12 comprising:

a line connected to said cable and routed under the seating area to emerge outside one of the arms at an elevation suitable for leg exercises.

16. An exercise apparatus comprising:

a couch having a seating area sized to seat more than one person, said couch comprising a pair of arms each having an inside and an outside;

an engagement means mounted at least partially inside said couch and having a distal end adapted for reciprocation, said engagement means comprising a cable having a pair of ends routed to emerge separately from the inside of respective ones of said arms above the seating area;

an exercise means coupled to said engagement means for applying a force to said distal end in order to exercise one who reciprocates said distal end, said exercise means including an adjustable weight coupled to said cable to be lifted in response to pulling of said cable, said cable being routed to form a bight for supporting and lifting said weight; and a pair of upper pulleys for guiding said cable, said cable extending upwardly from said bight to loop over said upper pulleys.

17. An exercise apparatus according to claim 16 wherein said cable is routed at least partially inside said couch to emerge for manual grasping.

18. An exercise apparatus according to claim 16 wherein said arms comprise:

a pair of stops separately mounted in different corresponding ones of said arms for preventing the ends of said engagement means from entering said arms and becoming manually inaccessible.

19. An exercise apparatus according to claim 16 comprising:

a pair of handles separately and detachably connected to the pair of ends of said engagement means.

20. An exercise apparatus according to claim 16 comprising:

a line connected to said engagement means and routed under the seating area to emerge outside one of the arms at an elevation suitable for leg exercises.

* * * * *